United States Patent [19]

Chen et al.

[11] 4,421,959

[45] Dec. 20, 1983

[54] BRIDGING CONTACTOR WITH MAIN AND ARCING CONTACTS

[75] Inventors: C. Gregory Chen, Brown Deer; Daniel A. Wycklendt, Milwaukee, both of Wis.

[73] Assignee: Eaton Corporation, Cleveland, Ohio

[21] Appl. No.: 369,762

[22] Filed: Apr. 19, 1982

[51] Int. Cl.[3] ..... H01H 9/38; H01H 15/00

[52] U.S. Cl. ..... 200/16 A; 200/146 R; 200/243; 335/201

[58] Field of Search ..... 200/16 A, 144 R, 146 R, 200/243-245, 280; 335/12-16, 201, 198, 128-132

[56] References Cited

U.S. PATENT DOCUMENTS

| | | | |
|---|---|---|---|
| 1,765,569 | 6/1930 | Corbett | 200/146 R |
| 2,352,550 | 6/1944 | Joseph | 200/146 R |
| 2,672,536 | 3/1954 | Rosing et al. | 335/129 |
| 2,756,291 | 7/1956 | Peter | 200/16 A |
| 3,129,304 | 4/1964 | Hyink et al. | 335/198 |
| 3,453,569 | 7/1969 | Ostby | 335/132 |
| 3,453,571 | 7/1969 | Koertge | 335/132 |
| 3,632,930 | 1/1972 | Parini | 200/146 R |
| 3,867,597 | 2/1975 | Jawelak | 200/146 R X |
| 4,039,983 | 8/1977 | Terracol et al. | 335/16 |

*Primary Examiner*—J. R. Scott

*Attorney, Agent, or Firm*—Andrus, Sceales, Starke & Sawall

[57] ABSTRACT

A bridging contact structure, suitable for use in AC contactors and the like, is provided with double-break stationary main contacts, and with double-break stationary arcing contacts in parallel with the main contacts. Silver usage in the main contacts is substantially reduced.

6 Claims, 2 Drawing Figures

BRIDGING CONTACTOR WITH MAIN AND ARCING CONTACTS

TECHNICAL FIELD

The invention relates to bridging contact structures with double-break main contacts, and with double-break arcing contacts in parallel with the main contacts. More specifically, the invention relates to a particular dual action structure enabling substantial reduction in silver usage.

BACKGROUND AND SUMMARY

Contact structures physically separating the current carrying and arcing functions of the contacts are known. The most common usage of this type of contact arrangement is in DC contactor design, employing single make type contact action. When the switch is turned ON, the arcing contact closes first followed by closure of the main contact in parallel with the arcing contact. When the switch is turned OFF, the main contact opens first followed by opening of the arcing contact, such that the latter experiences an arcing. This dual contact action is typical in DC contactors because of the high current loads required.

Double-break-and-make bridging contact structures are typical in AC contactor design. The double-break bridge structure is used to meet the particular requirements of AC interruption with a very simple, fairly compact, low cost device structure. In bridging type contact structures, it is common to employ silver contacts which are sized large enough to withstand any arcing, and have enough stock to afford a desired life rating in spite of deterioration caused by arcing.

In view of anticipated continuing increases in silver costs, it is a purpose of the present invention to reduce silver usage in bridging type contact structures, including AC contactors. A substantial reduction, for example 90–95%, in silver usage has been achieved by a particular contact structure affording dual contact action with double-break main contacts and couble-break arcing contacts.

The main contacts are rigidly fixed and comprise a thin stock of silver. The arcing contacts are likewise rigidly fixed and comprise copper cadmium oxide or thicker stock.

A bridging contact structure with double-break main contacts and double-break arcing contacts is shown in Terracol et al U.S. Pat. No. 4,039,983. The auxiliary arcing contacts are mounted to expandable loops electrodynmically operated.

DETAILED DESCRIPTION

Figure 1:
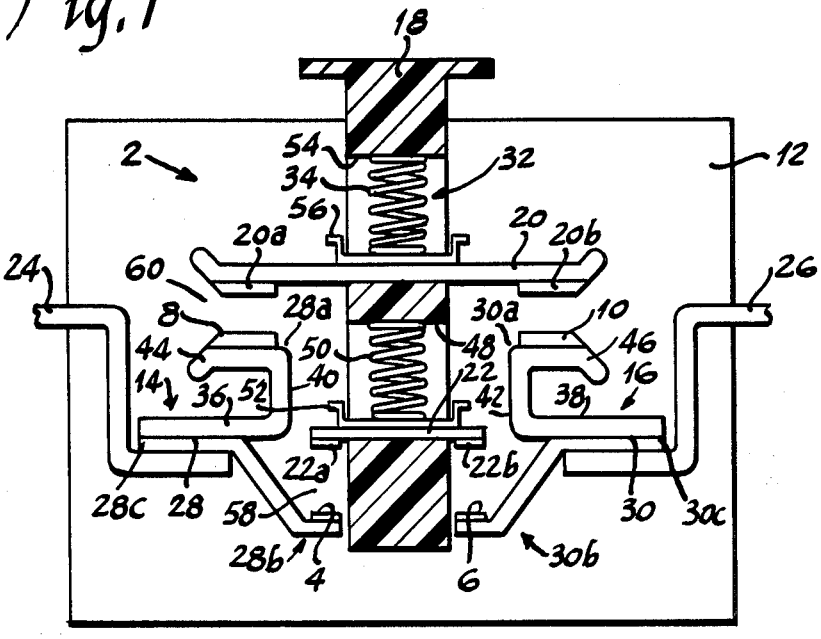
FIG. 1 is a sectional view of bridging contact structure constructed in accordance with the invention.
Figure 2:
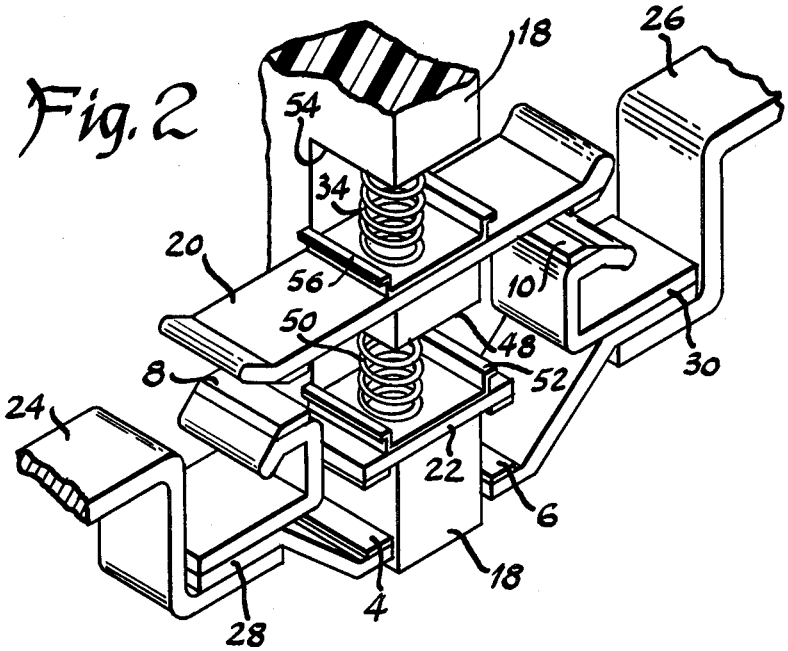
FIG. 2 is an isometric illustration of the structure of FIG. 1.

FIG. 1 shows bridging contact structure 2 with double-break main contacts 4 and 6, and double-break arcing contacts 8 and 10. Contact structure 2 is supported within a housing, schematically shown at 12, which may be like that shown in U.S. Pat. Nos. 2,672,536; 3,129,304; 3,453,569; or 3,453,571. Contact support means 14 and 16 are provided in the housing and support the pair of main contacts 4 and 6 in spaced stationary relation in parallel with spaced stationary arcing contacts 8 and 10.

Actuator means 18 is vertically movable in the housing and carries an arcing contactor 20 and a main contactor 22. Actuator 18 is movable downwardly to an ON position with the arcing contactor 20 engaging the arcing contacts 8 and 10, followed by the main contactor 22 engaging the main contacts 4 and 6. Actuator 18 is movable upwardly to an OFF position with the main contactor 22 disengaging the main contacts 4 and 6, followed by the arcing contactor 20 disengaging the arcing contacts 8 and 10. Arcing contactor 20 may include contacts **20*a* and 20*b* on its underside for engaging arcing contacts 8 and 10. Main contactor 22 may likewise include main contacts 22*a* and 22*b* on its underside for engaging main contacts 4 and 6. In the ON position, a circuit is completed between terminals 24 and 26 extending through the housing and respectively mounting the contact support means 14 and 16**. During turn-on, the arcing contacts make first, to thus experience any arcing and protect the main contacts. During turn-off, the main contacts break first, followed by break of the arcing contacts to thus experience any arcing.

Contact support means 14 and 16 comprise a pair of spaced opposed terminals 28 and 30 extending laterally towards each other. Terminal 28 has upper and lower branches **28*a* and 28*b* facing upper and lower branches 30*a* and 30*b* of the other terminal 30. The facing upper branches 28*a* and 30*a* mount on their top sides the respective arcing contacts 8 and 10. The facing lower branches 28*b* and 30*b* mount on their top sides the respective main contacts 4 and 6**.

Actuator 18 includes lost motion means 32 operative with arcing contactor 20 upon engagement of arcing contacts 8 and 10 to maintain such engagement during continued downward movement of actuator 18 to the ON position. Lost motion means 32 further maintains such engagement during return upward movement of actuator 18 towards its OFF position until main contactor 22 disengages main contacts 4 and 6. Actuator 18 comprises a plunger slidable up and down between facing terminal branches **28*a* and 30*a*, and 28*b* and 30*b*. Contactors 20 and 22 extend laterally across plunger 18 for butting engagement with respective contacts. Lost motion means 32 comprises resilient biasing means 34, such as a compression spring, bearing between plunger 18 and arcing contactor 20, and biased to a given loaded condition upon movement of plunger 18** to its downward ON condition.

Upper terminal branches **28*a* and 30*a* extend inwardly toward each other as shown at 36 and 38, then upwardly in parallel relation as shown at 40 and 42, and then outwardly away from each other as shown at 44 and 46. Arcing contacts 8 and 10 are mounted on the top side of these last mentioned portions 44 and 46 of the upper terminal branches 28*a* and 30*a*. Lower terminal branches 28*b* and 30*b* extend inwardly toward each other and terminate proximate plunger 18. Main contacts 4 and 6 are mounted on the top side of these last mentioned proximate portions of lower terminal branches 28*b* and 30*b***.

Main contactor 22 is mounted in a lower slot 48 in plunger 18 and is biased downwardly against the bottom of the slot by biasing means such as compression spring 50 bearing between the top of slot 48 and the top side of main contactor 22. Main contactor 22 may include a retaining plate 52 for receiving the bottom end of spring 50. Main contactor 22 extends laterally beyond slot 48 between the upper and lower terminal branches 28*a* and 30*a*, and 28*b* and 30*b*. Main contactor 22 engages main contacts 4 and 6 when plunger 18 is moved downwardly to the ON position. Biasing means 50 permits overtravel downwardly beyond the ON position. Main contactor 22 is spaced below upper terminal branches 28*a* and 30*a* when plunger 18 is in the upward OFF position.

Arcing contactor 20 is mounted in an upper slot 54 in plunger 18 and is biased downwardly against the bottom of slot 54 by spring 34 bearing between the top of slot 54 and the top side of arcing contactor 20. Contactor 20 may include a retaining plate 56 for receiving the bottom end of spring 34. Arcing contactor 20 extends laterally beyond upper slot 54 above upper terminal branches 28*a* and 30*a*.

Terminals 28 and 30 have coplanar outer root ends 28*c* and 30*c* extending coplanarly inwardly towards each other to initiate upper terminal branches 28*a* and 30*a*, and extending downwardly and then laterally coplanarly inwardly to form lower terminal branches 28*b* and 30*b*. The gap 38 between the main contacts and main contactor 22 in the OFF position of plunger 18 is greater than the gap 60 between the arcing contacts and arcing contactor 20.

Contact structure 2 reaches the end of its useful life when the two gaps 58 and 60 become equal. This in turn is caused by deterioration of arcing contacts 8 and 10 and 20*a* and 20*b* due to arcing. In preferred form, the arcing contacts are a thick stock of copper cadmium oxide, CuCdO. The main contacts are substantially smaller and are thin stock silver, Ag. It has been found that contact structure 2 enables a 90–95% reduction in silver usage for the main contacts as compared with a bridging structure with arcing main contacts of comparable current rating.

It is recognized that various modifications are possible within the scope of the appended claims.

We claim:

1. A bridging contact structure with double-break main contacts and double-break arcing contacts, comprising:

a housing;

contact support means in said housing and having a pair of spaced stationary main contacts in parallel with a pair of spaced stationary arcing contacts;

actuator means movable in said housing and carrying a main conductor and an arcing contactor, said actuator means being movable to an ON position with said arcing contactor engaging said arcing contacts followed by said main contactor engaging said main contacts, said actuator means being movable to an OFF position with said main contactor disengaging said main contacts followed by said arcing contactor disengaging said arcing contacts; said actuator means includes lost motion means operative with said arcing contactor upon engagement of said arcing contacts to maintain such engagement during continued movement of said actuator means to said ON position, and further maintaining such engagement during return movement of said actuator means towards said OFF position until said main contactor disengages said main contacts;

said contact support means comprises a pair of spaced opposed terminals extending laterally towards each other, each terminal having an upper and lower branch facing the upper and lower branch of the other terminal, the facing upper branches mounting a respective pair of said contacts, and the facing lower branches mounting the other pair of said contacts;

said actuator means comprises a plunger slideable up and down between said facing terminal branches, said contactors extending laterally across said plunger for butting engagement with respective said contacts;

said lost motion means comprises resilient biasing means bearing between said plunger and said arcing contactor and biased to a given loaded condition upon movement of said plunger to said ON condition.

2. The invention according to claim 1 wherein:

said upper terminal branches extend inwardly toward each other, then upwardly in parallel relation, and then outwardly away from each other, and wherein said arcing contacts are mounted on top of said last mentioned portions of said upper terminal branches;

said lower terminal branches extend inwardly toward each other and terminate proximate said plunger, and wherein said main contacts are mounted on top of said last mentioned proximate portions of said lower terminal branches.

3. The invention according to claim 2 wherein:

said main contactor is mounted in a lower slot in said plunger and is biased downwardly against the bottom of the slot by biasing means bearing between the top of the slot and the top side of said main contactor, said main contactor extending laterally beyond said slot between said upper and lower terminal branches, said main contactor engaging said main contacts when said plunger is moved downwardly to the ON position, said biasing means permitting overtravel downwardly beyond said ON position, said main contactor being spaced below said upper terminal branches when said plunger is in the OFF position;

said arcing contactor is mounted in an upper slot in said plunger and is biased downwardly against the bottom of said upper slot by said first mentioned biasing means bearing between the top of said upper slot and the topside of said arcing contactor, said arcing contactor extending laterally beyond said upper slot above said upper terminal branches.

4. The invention according to claim 3 wherein:

said terminal branches have coplanar outer root ends and extend coplanarly inwardly towards each other to initiate said upper terminal branches, and extend downwardly and then laterally coplanarly inwardly to form said lower terminal branches.

5. The invention according to claim 1 wherein said arcing contacts comprise CuCdO, and said main contacts are substantially smaller and comprise Ag.

6. A bridging contact structure with double-break mean contacts and double-break arcing contacts, comprising:

housing means;

stationary support means in said housing means and having a pair of spaced, fixed main contacts and a pair of spaced, fixed arcing contacts;

actuator means movable in said housing and carrying an arcing contactor for engaging said arcing contacts in bridging relation, and carrying a main contactor for engaging said main contacts in bridging relation in parallel with said arcing contacts, said actuator means being movable in a first direction such that said arcing bridging contactor engages said arcing contacts, said actuator means including lost motion means co-acting with said arcing bridging contactor to permit further movement of said actuator means in said first direction at least until said main bridging contactor engages said main contacts, said actuator means being movable in a return direction such that said main bridging contactor disengages said main contacts first, followed by disengagement of said arcing bridging contactor from said arcing contacts upon return to an OFF position through the lost motion previously permitted by said lost mostion means;

the gap between said main contacts and said main contactor in the OFF position of said plunger is greater than the gap between said arcing contacts and said arcing contactor, said contact structure reaching the end of its useful life when the two said gaps become equal, which in turn is caused by deterioration of said arcing contacts due to arcing.

* * * * *